US010806980B2

(12) United States Patent
Hebreo et al.

(10) Patent No.: US 10,806,980 B2
(45) **Date of Patent: *Oct. 20, 2020**

(54) GOLF CLUB WITH INTERCHANGEABLE SOLE

(71) Applicant: Acushnet Company, Fairhaven, MA (US)

(72) Inventors: Jonathan Hebreo, San Diego, CA (US); Grant M. Martens, San Diego, CA (US); Oswaldo Gonzalez, San Jacinto, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/542,491

(22) Filed: Aug. 16, 2019

(65) Prior Publication Data

US 2019/0366175 A1 Dec. 5, 2019

Related U.S. Application Data

(63) Continuation of application No. 15/857,485, filed on Dec. 28, 2017, now Pat. No. 10,384,105.

(51) Int. Cl.

| | |
|---|---|
| ***A63B 60/42*** | (2015.01) |
| ***A63B 53/04*** | (2015.01) |
| ***A63B 53/06*** | (2015.01) |
| ***A63B 60/02*** | (2015.01) |
| *A63B 102/32* | (2015.01) |

(52) U.S. Cl.

CPC ..... *A63B 60/42* (2015.10); *A63B 53/047* (2013.01); *A63B 53/0475* (2013.01); *A63B 53/06* (2013.01); *A63B 53/0408* (2020.08); *A63B 53/0433* (2020.08); *A63B 60/02* (2015.10); *A63B 2053/0491* (2013.01); *A63B 2102/32* (2015.10); *A63B 2209/00* (2013.01)

(58) Field of Classification Search

CPC ..... A63B 60/42; A63B 53/0475; A63B 53/06; A63B 2102/32; A63B 60/02; A63B 2209/00

USPC ..... 473/345

See application file for complete search history.

(56) References Cited

U.S. PATENT DOCUMENTS

| | | | | |
|---|---|---|---|---|
| 1,128,288 | A | 2/1915 | Churchill | |
| 1,322,182 | A * | 11/1919 | Duncan | A63B 53/04 473/344 |
| 1,433,744 | A | 10/1922 | Rhind | |
| 1,607,284 | A | 11/1926 | Kraeuter | |
| D84,525 | S | 6/1931 | Klin | |
| 2,041,676 | A | 5/1936 | Gallagher | |
| 2,332,342 | A * | 10/1943 | Reach | A63B 53/04 473/248 |
| 3,761,095 | A | 11/1973 | Thompson | |
| 4,332,388 | A | 6/1982 | Crow | |
| 4,775,156 | A | 10/1988 | Thompson | |
| 5,362,047 | A * | 11/1994 | Shaw | A63B 53/04 473/291 |

(Continued)

*Primary Examiner* — Michael D Dennis
(74) *Attorney, Agent, or Firm* — Kristin D. Wheeler

(57) ABSTRACT

The golf club head has a body including a hosel, topline, face and a back section, an opening in the body provided between the back section and the face, and a sole member provided to mate with the opening where the sole member has a sole portion, a bend portion and a bridge portion connecting the sole portion to the bend portion.

22 Claims, 5 Drawing Sheets

(56) References Cited

U.S. PATENT DOCUMENTS

| | | | | |
|---|---|---|---|---|
| 5,386,996 | A | 2/1995 | Hiruta | |
| 5,435,551 | A | 7/1995 | Chen | |
| 5,439,223 | A | 8/1995 | Kobayashi | |
| 5,807,186 | A | 11/1998 | Chen | |
| 5,833,551 | A * | 11/1998 | Vincent | A63B 53/04 473/350 |
| 5,938,540 | A | 8/1999 | Lu | |
| 7,588,503 | B2 * | 9/2009 | Roach | A63B 53/047 473/332 |
| 7,871,336 | B2 | 1/2011 | Breier et al. | |
| 8,105,175 | B2 | 1/2012 | Breier et al. | |
| 8,491,405 | B2 * | 7/2013 | Jorgensen | A63B 60/00 473/288 |
| 8,753,219 | B2 * | 6/2014 | Gilbert | A63B 60/54 473/291 |
| 8,821,307 | B2 | 9/2014 | Park | |
| 8,911,302 | B1 * | 12/2014 | Ivanova | A63B 53/0475 473/329 |
| 9,033,813 | B2 | 5/2015 | Oldknow et al. | |
| 10,137,341 | B2 * | 11/2018 | Greer | A63B 53/06 |
| 2010/0041493 | A1 | 2/2010 | Clausen | |
| 2013/0109497 | A1 * | 5/2013 | Ban | A63B 53/06 473/330 |
| 2017/0095707 | A1 * | 4/2017 | Ripp | A63B 53/06 |

* cited by examiner

SECTION B-B

GOLF CLUB WITH INTERCHANGEABLE SOLE

RELATED APPLICATIONS

The current application is a continuation of U.S. patent application Ser. No. 15/857,485, entitled Golf Club With Interchangeable Sole, filed Dec. 28, 2017, currently pending, the disclosure of which is incorporated by reference in its entirety.

FIELD OF THE INVENTION

The present invention relates to an improved golf club head. More particularly, the present invention relates to a golf club head having an interchangeable sole.

BACKGROUND

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

It is a goal for golfers to reduce the total number of swings needed to complete a round of golf, thus reducing their total score. To achieve that goal, it is generally desirable for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance very time the golfer strikes the ball, even when the golfer strikes the ball in the "sweet spot" of the golf club.

Different player swings can have different results with the same iron-type golf club. The speed with which a player can swing the golf club will determine the performance of the club for that player. It is desirable to have a golf club that would adjust the face performance to match the player's swing speed. Moreover, different swings interact with the turf differently. It is desirable to have an iron-type golf club that would have a sole fitting feature allowing for adjustability in the iron-type golf club.

Thus, it is desirable to have an iron-type golf club head that can optimize launch conditions at impact and turf interaction for players.

SUMMARY OF THE INVENTION

The present invention relates to a golf club head including a sole member attached to the body of the club head. It will be appreciated that multiple sole members may be attached to optimize the launch conditions at impact for different player swing types and the sole can also be changed to dial in the turf interaction for the player In one aspect of the present invention a golf club head is provided comprising a body having a hosel, topline, face and a back section. An opening in the body is provided between the back section and the face and at least one sole member is provided to mate with the opening. The sole member has a sole portion with a front edge in contact with the face, and a bend portion in contact with the back section of the body and a bridge portion connecting the sole portion and the bend portion.

The golf club head may further comprise first and second sole members where the first and second sole members have a different bounce profile. The bridge may have an angle relative to the ground plane and the angle may be between about 30 degrees and about 60 degrees. The opening may be completely covered by the sole member. The sole portion preferably has a thickness from about 1 mm to about 4 mm. The bridge preferably has a thickness from about 1 mm to about 4 mm. The bridge may be connected to the sole portion by a blend region and the blend region may have a width and the width may be between about 1 mm and 4 mm. The sole member may have a sole portion with a rear edge in contact with a bottom of the back section. The rear edge may be in contact with the back section and have a length of about 3 mm to 10 mm. The face may have a variable face thickness from about 1.9 mm to about 2.1 mm. The variable face thickness may increase from the sole to the topline. The sole member may be attached to the body at a mid-point of the back section. A sole slot may be provided in the body for receiving a heel and toe of the sole portion of the sole member. Additionally, fasteners may be provided connecting the sole member in the opening to the mid-point of the back section.

In another aspect of the present invention a golf club head is provided comprising a main body defining a hosel, a back section, and a face, the face having a ball striking surface, a leading edge and a rear surface. An opening in the body is provided between the back section and the rear surface of the face and at least two sole members are provided shaped to be selectively positioned in the opening and attached to the main body. The sole member includes a sole portion having a front edge in contact with the rear surface of the face, and a bend portion in contact with the back section of the body and a bridge portion connecting the sole portion and the bend portion, where the sole members have different bounce profiles.

The bridge may have an angle relative to the ground plane and the angle may be between about 30 degrees and about 60 degrees. The opening may be completely covered by the sole members. The selected sole member may be attached to the body at a mid-point of the back section. Additionally, fasteners may be provided connecting the sole member in the opening to the mid-point of the back section. The face may have a variable face thickness from about 1.9 mm to about 2.1 mm. The variable face thickness may increase from the sole to the topline. The sole portion preferably has a thickness from about 1 mm to about 4 mm. The bridge preferably has a thickness from about 1 mm to about 4 mm. A sole slot may be provided in the body for receiving a heel and toe of the sole portion of the sole member.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention. Preferred features of the present invention are disclosed in the accompanying drawings, wherein similar reference characters denote similar elements throughout the several views, and wherein.

DETAILED DESCRIPTION OF THE PREFERRED EMBODIMENT

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above. Further, one or more of the problems discussed above may not be fully addressed by any of the features described below.

Figure 1:
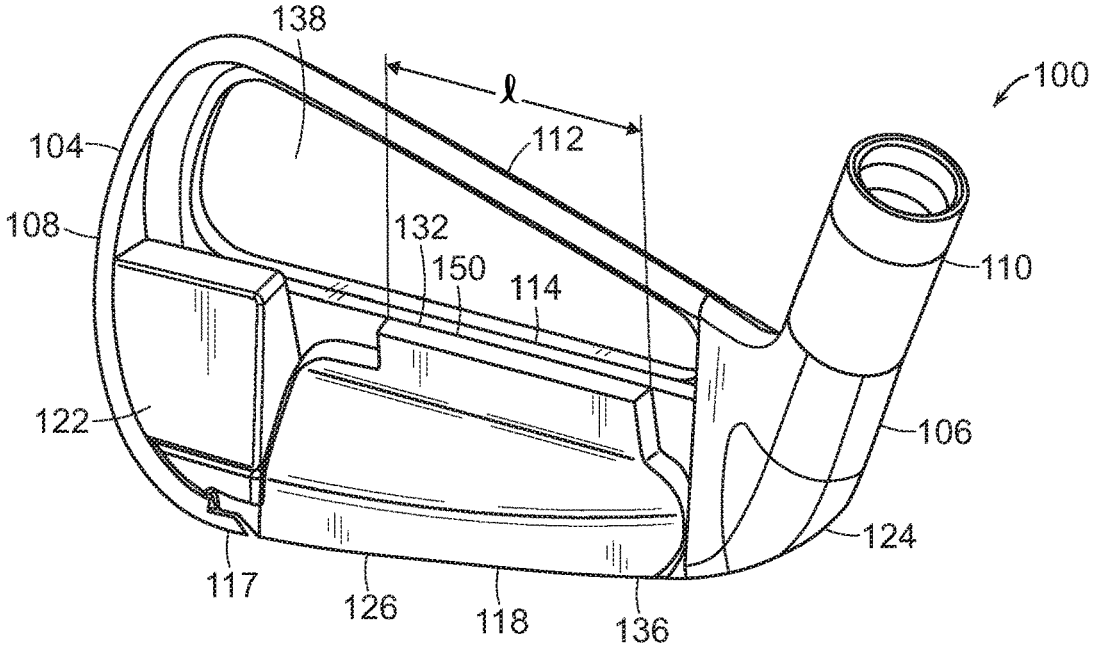
FIG. 1 is a rear perspective view of an embodiment of a golf club head of the present invention.
Figure 2:
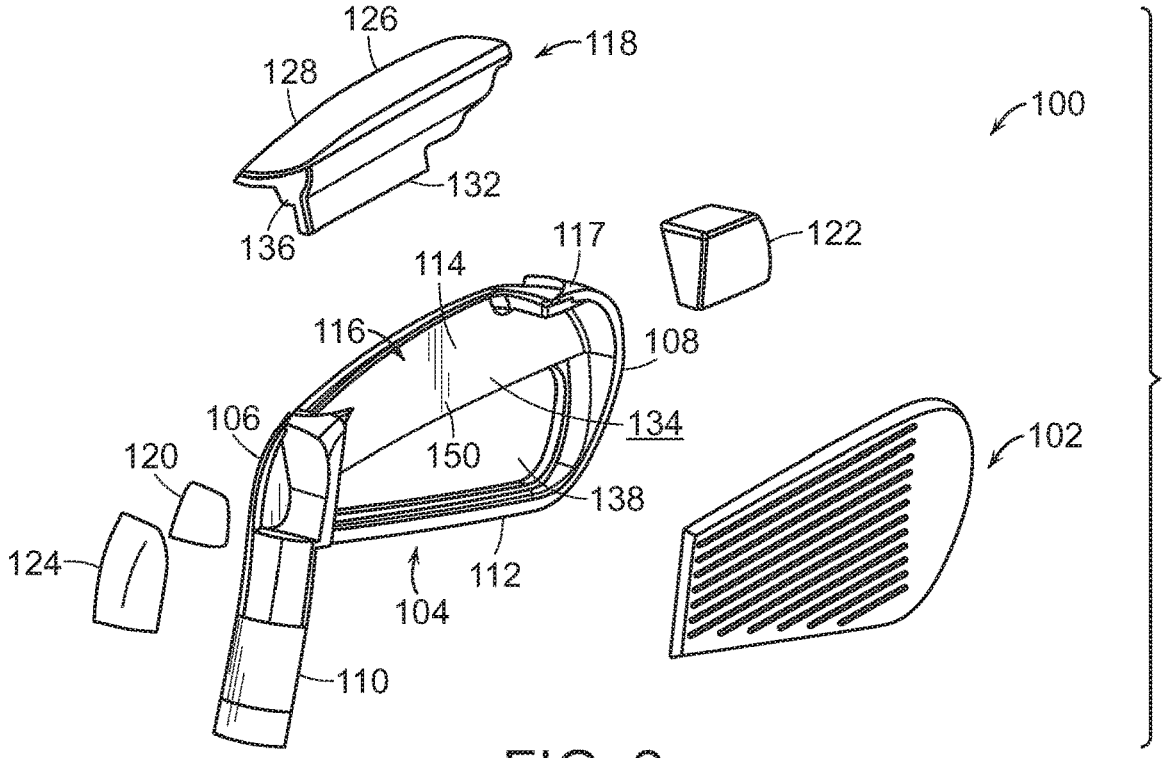
FIG. 2 is an exploded view of the golf club head of FIG. 1.

FIGS. 1 and 2 illustrate a rear perspective view and an exploded view of the present invention. A golf club head 100 is provided having face 102 and a body 104. The body 104 has a heel portion 106 and a toe portion 108 opposite the heel portion 106, a hosel 110 at the heel portion 106, topline 112, and a back section 114. An opening 116 in the body 104 is provided between the back section 114 and the face 102. At least one sole member 118 is provided to mate with the opening 116 in the sole 117 of the club head 100. In the specific embodiment shown in FIGS. 1-2, the club head 100 optionally includes a heel weight 120 and a toe weight 122 provided respectively at the heel portion 106 and toe portion 108 of the club head 100. The heel weight 120 as shown may include a heel cap 124 to cover the heel weight 120. The sole member 118 has a sole portion 126 having a front edge 128 (FIG. 4) in contact with a back surface 130 (FIG. 4) of the face 102, and a bend portion 132 in contact with an interior surface 134 (FIG. 4) the back section 114 of the body 100 and a bridge portion 136 provided between the sole portion 126 and the bend portion 132.

Figure 3:
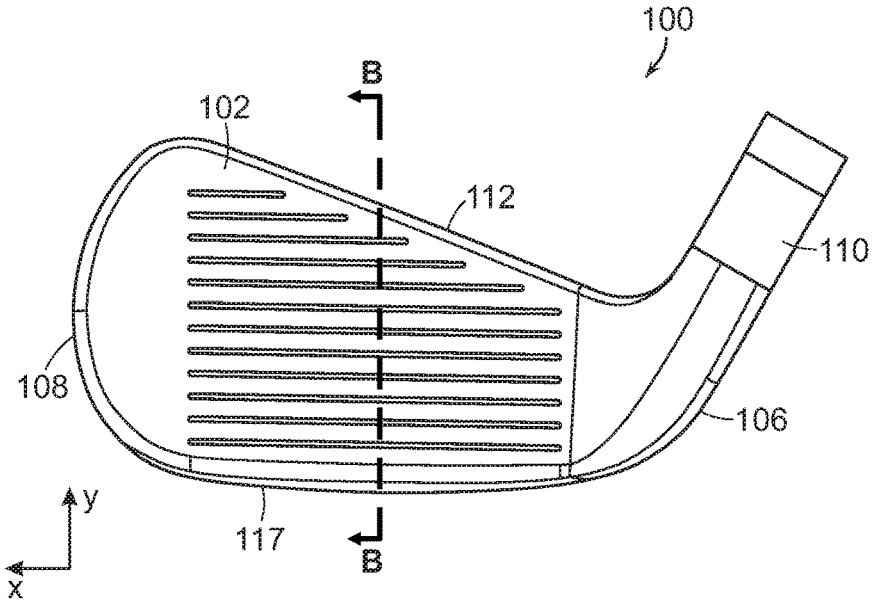
FIG. 3 is a front view of the golf club head of FIG. 1.

FIG. 3 is a front view of the golf club head of FIG. 1 and shows the face 102 and hosel 110 of the golf club head 100. As shown, it will be appreciated that the face 102 may be formed separately; however, it will be appreciated that the face 102 may also be formed as a part of the body 104. As is clear from FIG. 1, the back surface 130 of the face 102 may be visible through a second opening 138 in the rear of the body 104 provided between the topline 112 and the back section 114. It will be appreciated that this second opening 138 may be covered with another piece such as a medallion or cap (not shown).

Figure 4:
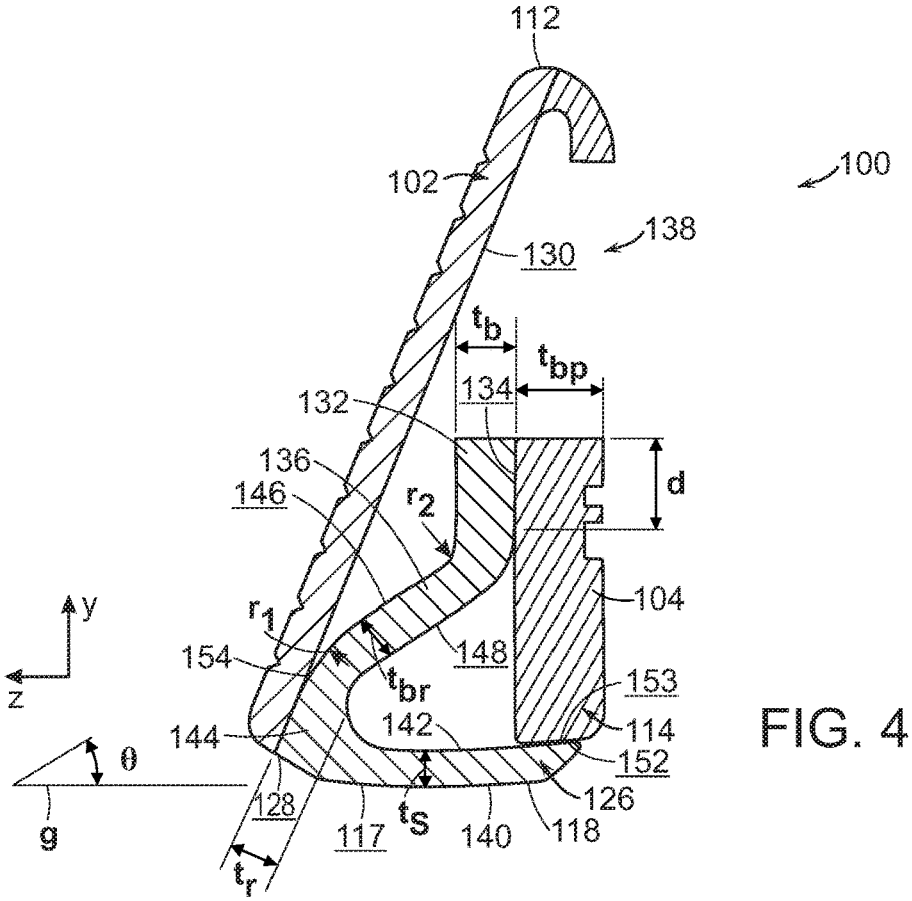
FIG. 4 is a cross-sectional view, corresponding to line B-B of FIG. 3.

Referring now to FIG. 4, a cross-sectional view of the club head 100 is shown taken along line B-B of FIG. 3. As can be readily seen in the cross-section, the sole member 118 has the sole portion 126 with a bottom surface 140 that is exposed on the exterior of the club head 100 and an inner surface 142 opposite the bottom surface 140. The bottom surface 140 is the portion of the club head 100 that is in contact with turf during play. Preferably, the sole portion 126 is positioned horizontally. The sole portion 126 may have a thickness $t_s$ from about 1 mm to about 4 mm, and as shown about 2.1 mm. The front edge 128 of the sole portion 126 is provided in contact with the back surface 130 of the face 102. It will be appreciated that this is a point of contact with the back surface 130 along the front edge 128 of the sole portion 126. Adjacent the front edge 128 is a blend region 144. The blend region 144 has a thickness $t_r$ of about 1 mm to 4 mm, and as shown about 2.8 mm. The blend region 144 attaches the sole portion 126 with the bridge portion 136. The blend region 144 features a taper rebound 154 adjacent the front edge 128. The taper rebound 154 effects the interaction between the blend region 144 and the face 102 during impact which causes the sole portion 126 to move downward and the bridge portion 136 to become more vertical. It is anticipated that the bridge portion 136 has an angle θ relative to the ground plane g when the club is held at address. Preferably, the angle θ is between about 30 degrees and about 60 degrees, and as shown in FIG. 2 about 45 degrees. A radius $r_1$ is provided between the blend region 144 and the bridge portion 136 of about 5 mm to 25 mm, and as shown 10 mm. The bridge portion 136 has a first surface 146 and a second surface 148. The bridge portion 136 has a thickness $t_{br}$ between the first and second surfaces 146, 148 of about 1 mm to about 4 mm, and as shown about 2.85 mm. The bridge portion 136 is attached to the bend portion 132. Preferably, the bend portion 132 is positioned vertically. It will be appreciated that the bend portion 132 may have any suitable thickness $t_b$, preferably about 1 mm to about 4 mm. As shown the thickness $t_b$ of the bend portion 132 is about 3.4 mm. A second radius $r_2$ is provided between the bridge portion 136 and the bend portion 132 of about 1 mm to 10 mm, and as shown about 2 mm. The bend portion 132 is connected to the back section 114 of the club head 100 at interior surface 134. Preferably, the bend portion 132 is connected to the back section 114 along a distance d of about 3 mm to about 10 mm, and as shown about 5.3 mm. The back section 100 preferably has a thickness of $t_{bp}$ of about 1 mm to about 6 mm, as shown about 5 mm. As will be appreciated from FIGS. 1 and 2, the bend portion 132 of the sole member 126 is connected to the back section 114 of the body along the length 1 of the bend portion 132. Preferably, the connection is over an area of about 100 $mm^2$ to about 500 $mm^2$, and as shown about 175 $mm^2$. It will be appreciated that the sole member 118 is preferably attached to the body 104 of the club head 100 at the connection between the bend portion 132 and the back section 114 of the body 104. Preferably, a mid-point 150 of the interior surface 134 of back section 114 of the body 104 is attached to the bend portion 132 of the sole member 118. This attachment may be achieved by any suitable means, such as by welding or fasteners. It will be appreciated that because the sole member 118 is attached to the body 104 at the bend portion 132 and back section 114, when a golf ball strikes the face 102 the sole portion 126 will deflect downward causing the bridge portion 136 to be more vertical during impact. One of skill in the art will understand that the attachment of the bend portion 132 to the back section 114 of the club head 100 is preferably not pre-loaded against the back surface 130 of the face 102 of the club head 100.

Figure 5:
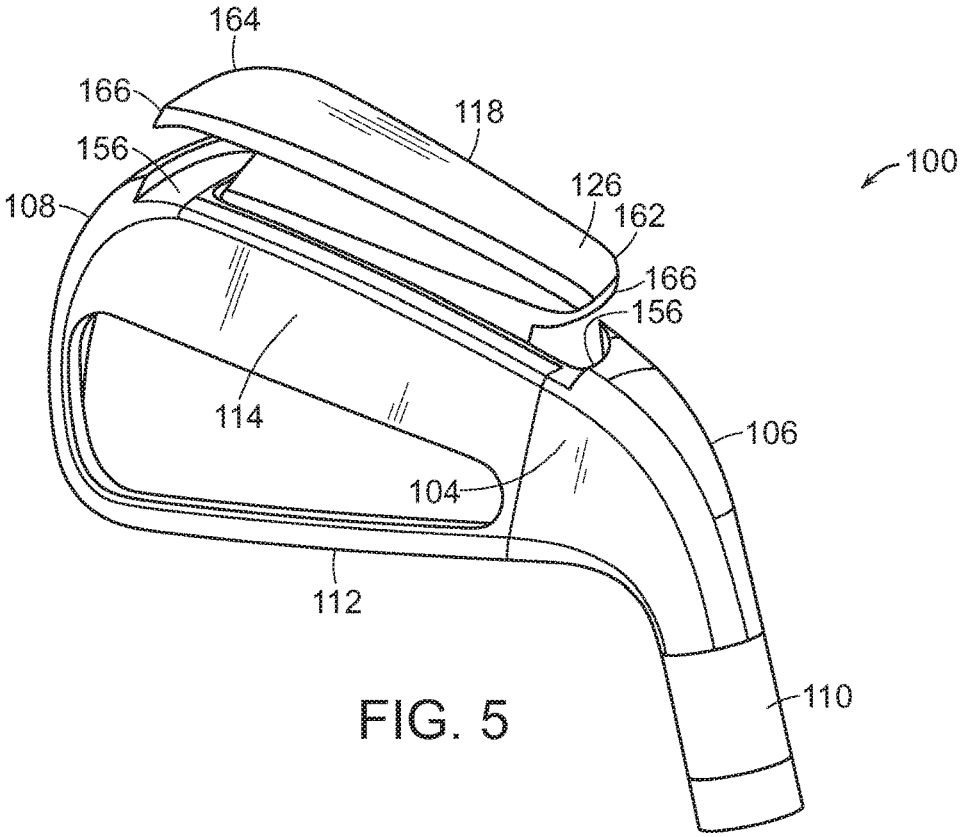
FIG. 5 is a bottom rear cross-sectional perspective view of the embodiment of FIG. 1.
Figure 6:
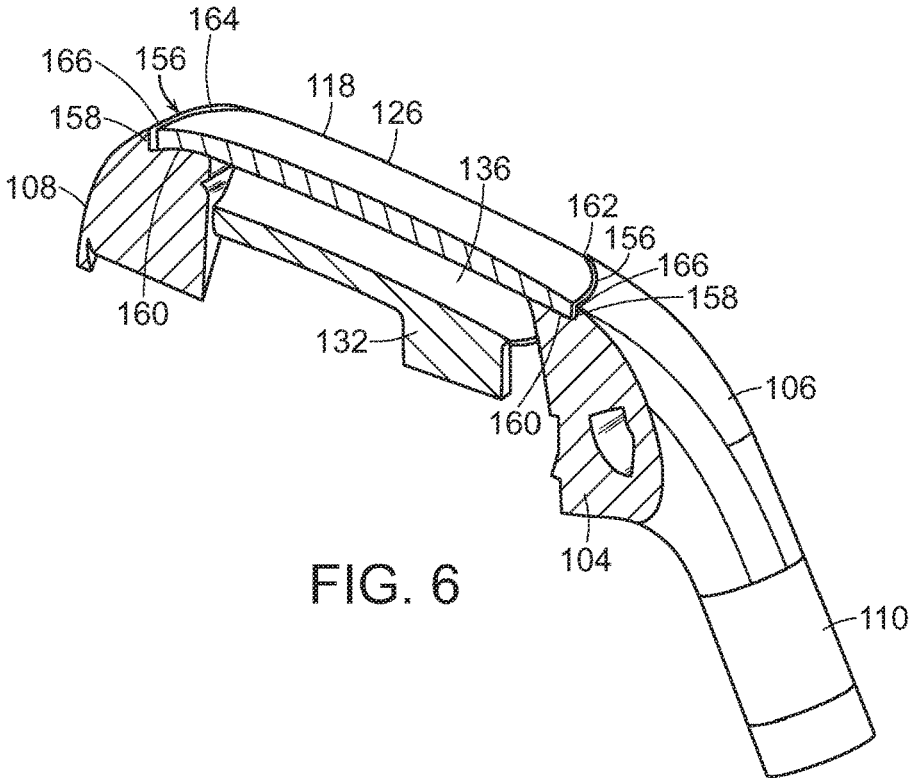
FIG. 6 is a bottom rear perspective view of FIG. 1, without the face.
Figure 7:
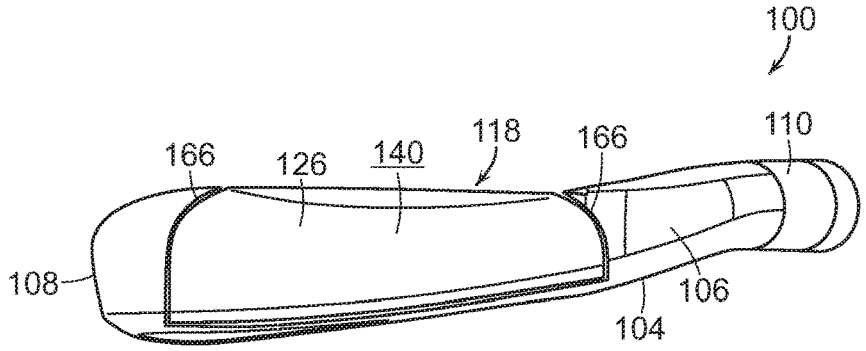
FIG. 7 is a bottom view of the club head of FIG. 1.

Now referring to FIGS. 5-7, the sole member 118 and its connection to the body 104 is shown. Sole slots 156 are provided in the heel portion 106 and toe portion 108 of the body 104 for receiving the sole portion 126 of the sole member 118. The sole slots 156 feature a rail portion 158 and slide portion 160 that interact with the heel 162 and toe 164 end surfaces 166 of the sole portion 126. As shown in the cross-sectional view of FIG. 9, the rail portions 158 engage with the end surfaces 166 of the sole portion 126. The rail portions 158 assist in guiding the sole member 118 into the opening 116 in the body 104 of the club head 100 and prevent the sole member 118 from twisting during impact with a golf ball. Thus, the sole portion 126 of the sole member 118 can deflect downward during impact without twisting during off-center hits.

Figure 8:
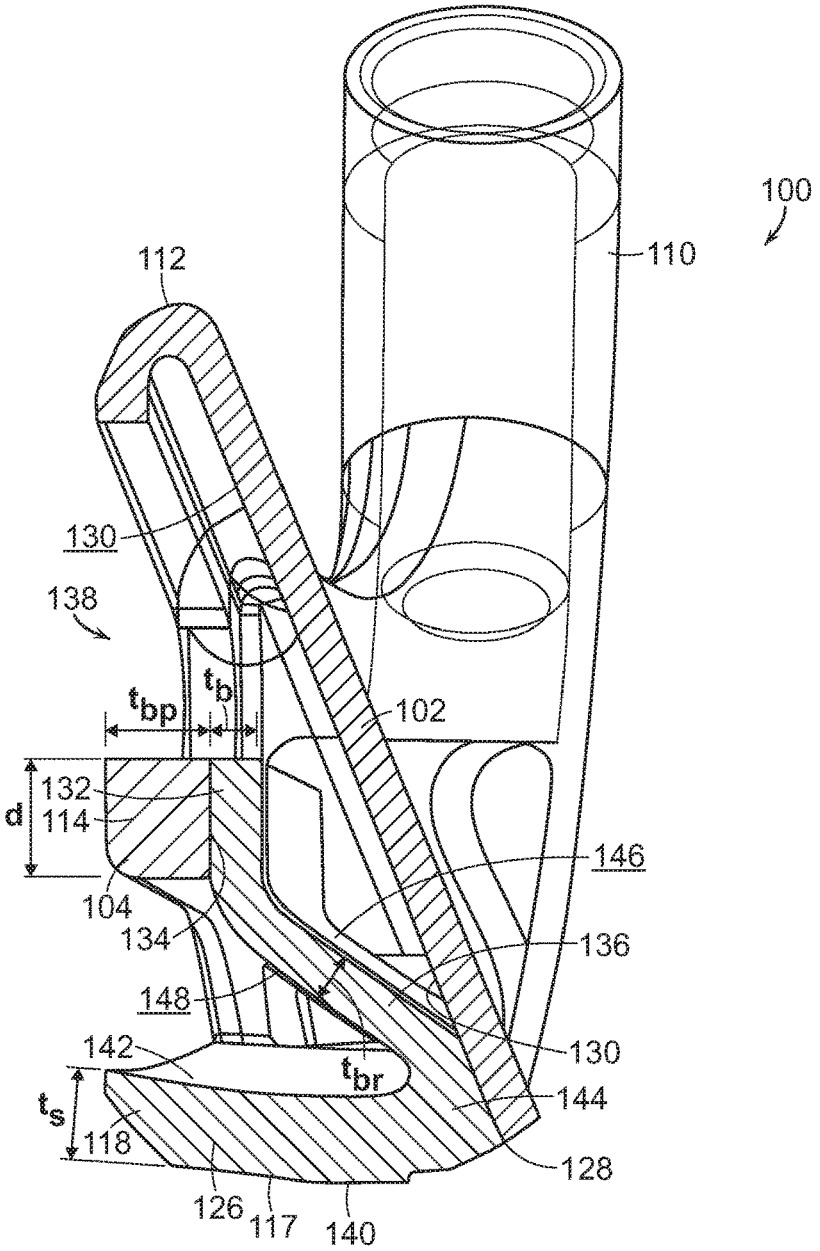
FIG. 8 is a cross-sectional view of another embodiment of the present invention.

In the embodiment of FIGS. 1-7, the inner surface 142 of the sole portion 126 and second surface 148 of the bridge portion 136 are completely covered by the back section 114 of the body 104, such that sole portion 126 has a rear edge 152 in contact with a bottom 153 of the back section 114. In an alternative embodiment shown in FIG. 8, the back section 114 does not cover the inner surface 142 of the sole portion 126 and the second surface 148 of the bridge portion 136. The bridge portion 136 in the embodiment of FIG. 8 is exposed and can be viewed. Thus, the back section 114 is not connected to the sole portion 126 of the sole member 118 in the embodiment of FIG. 8. Moreover, in the embodiment of FIG. 8, the blend region 144 is in contact with the back surface 130 of the face 102, not just the front edge 128 of the sole portion 126.

It will be appreciated that more than one sole member 118 may be provided, such that the first and second sole members 118 have a different bounce profile. The sole members 118 are formed to be selectively positioned in the opening 116 and attached to the body 104. The sole member 118 as previously described, includes a sole portion 126 having a front edge 128 in contact with the back surface 130 of the face 102, and a bend portion 132 in contact with the back section 114 of the body 104 and a bridge portion 136 provided between the sole portion 126 and the bend portion 132. Preferably, the sole members 118 have different bounce profiles. Thus, it is envisioned that the different sole members 118 may be used to fit different golfers to the same club. Alternatively, the different sole members 118 may be used to modify the golf club for a single player. It is envisioned that more than one sole member 118 may be provided with the club head 100, either for fitting or playability purposes. The different sole members 118 may have various different characteristics. For example, the sole portion 126 of the sole member 118 may have one or more of the following characteristics being different including bounce angle, camber or sole width.

Figure 9:
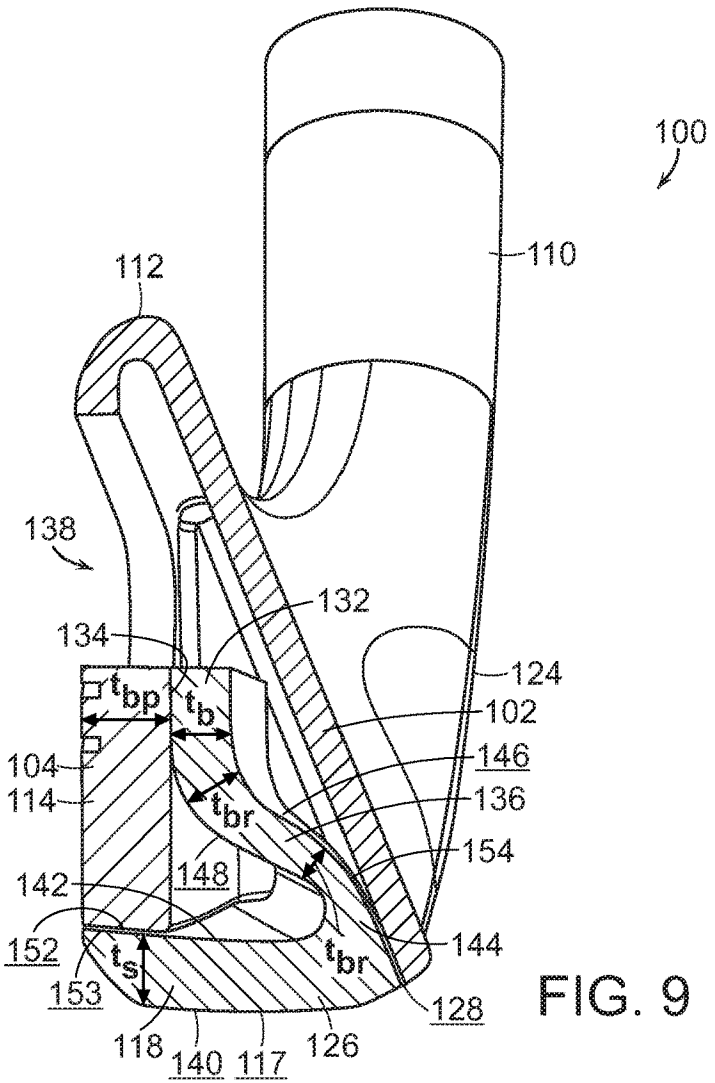
FIG. 9 is a cross-sectional view of another embodiment of the present invention.

Yet another embodiment of the present invention is shown in FIG. 9. In this embodiment the cross-section of the club head 100 is shown. The sole portion 126 of the sole member 118 is thicker in this embodiment relative to the bend portion 132 and bridge portion 136. Moreover, it will be apparent that the bridge portion 136 in the embodiment of FIG. 9 tapers in thickness $t_{br}$. Specifically, in this embodiment the bridge thickness $t_{br}$ is thinner adjacent the sole portion 126 than adjacent the bend portion 132. Preferably, the bridge portion 136 has a thickness $t_{br}$ that tapers continuously from adjacent the bend portion 132 to adjacent the sole portion 126.

Figure 10:
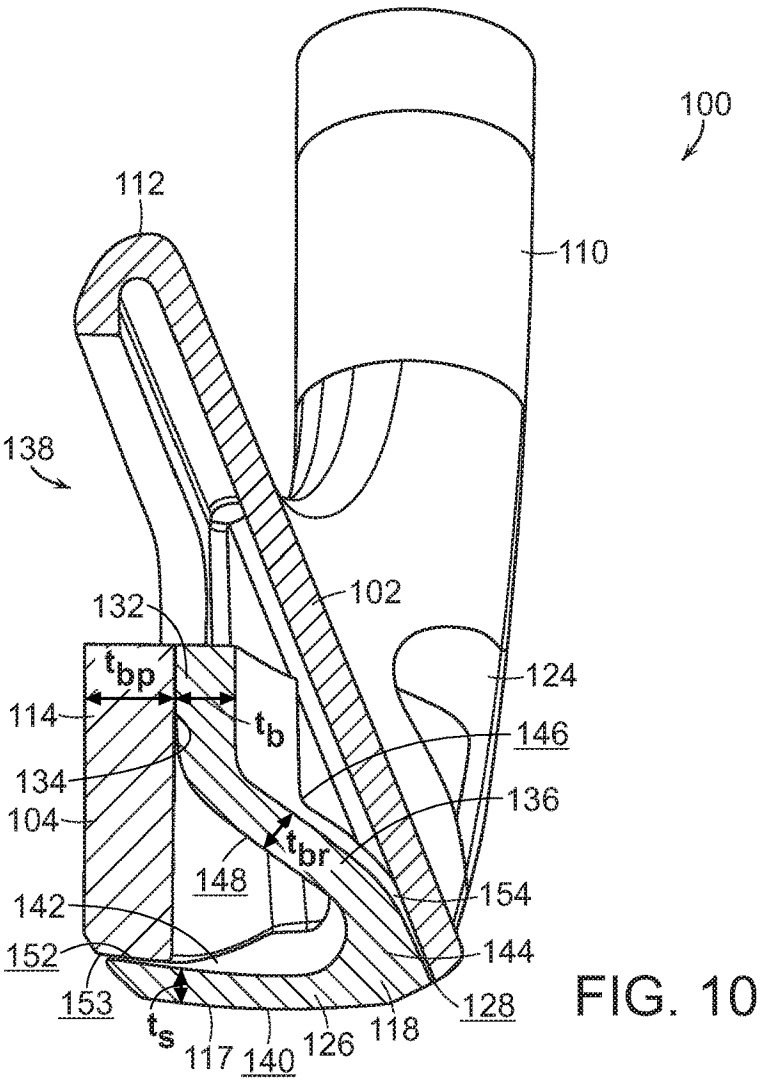
FIG. 10 is a cross-sectional view of another embodiment of the present invention.

Another embodiment is shown in FIG. 10. In this embodiment the bend portion 132 is thicker relative to the bridge portion 136 and the sole portion 126. The face 102 in this embodiment features a variable face thickness. As shown, the face 102 varies in thickness $t_f$ from the bottom of the face 102 adjacent the sole 117 to the top of the face adjacent the topline 112, such that the thickness of the face $t_f$ increases from the bottom to the top of the face 102 preferably from 1.6 mm to 2.4 mm. As shown, the thickness $t_f$ varies from about 1.9 mm adjacent the sole 117 to about 2.1 mm adjacent the topline 112. It will be appreciated that any embodiment incorporating the present invention may have a variable face thickness.

It will be appreciated that the sole member 118, comprising the sole portion 126, blend region, bridge portion 136, and bend region 132, is preferably formed as one-piece. However, they may be formed separately and attached to one another by any suitable method. It will be appreciated that as used herein the term connected is used to mean adjacent to, and that the parts may or may not be attached to one another.

It will be appreciated that the golf club head 100 may be made of any type of material or combinations thereof as is known in the art whether metal or non-metal materials. For example, in the embodiment of FIGS. 1-2, the heel and toe weights are made of a material having a higher specific gravity. Preferably, a specific gravity of about 14 g/cc, such as with tungsten. The body 104, sole member 118, and heel cap 124 are preferably made of steel, such as 17-4 steel, and the face 102 is preferably made of Aermet 340 steel.

The golf club head 100 body 104 may be made by any known method, including casting, forging or machining. The sole member 118 may be made by any known method, including casting, stamping from a sheet, or forging. It will be appreciated that the face 102 of the body 104 may be formed separately, such as by casting or forging, as is known in the art and attached to the body 104 of the club head 100. For example, the face 102 may be welded to the body 104.

Other than in the operating example, or unless otherwise expressly specified, all of the numerical ranges, amounts, values and percentages such as those for measurements, amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

We claim:

1. A golf club head comprising:

a body having a hosel, topline, face and a back section;

an opening in the body formed by the back section being spaced from the face; and at least one sole member provided to mate with the opening, the sole member including a sole portion having a front edge in contact with the rear surface of the face adjacent thea leading edge, and a bend portion attached to at least a portion of the back section of the body and spaced from the face and a bridge portion joining the sole portion and the bend portion and wherein the bridge has an angle relative to a ground plane and the angle is between about 30 degrees and about 60 degrees.

2. The golf club head of claim 1, further comprising first and second sole members wherein the first and second sole members have a different bounce profile.

3. The golf club head of claim 1, wherein the opening is completely covered by the sole member.

4. The golf club head of claim 1, wherein the sole portion has a thickness from about 1 mm to about 4 mm.

5. The golf club head of claim 1, wherein the bridge has a thickness from about 1 mm to about 4 mm.

6. The golf club head of claim 1, wherein the bridge is connected to the sole portion by a blend region and the blend region has a width and the width is between about 1 mm and 4 mm.

7. The golf club head of claim 1, wherein the face has a variable face thickness from about 1.9 mm to about 2.1 mm.

8. The golf club head of claim 7, wherein the variable face thickness increases from the sole to the topline.

9. The golf club head of claim 1, further comprising a mid-point of the back section and the sole member is attached to the body at the mid-point of the back section.

10. The golf club head of claim 1, further comprising a sole slot provided in the body for receiving a heel and toe of the sole portion of the sole member.

11. The golf club head of claim 1, further comprising fasteners connecting the sole member in the opening to a mid-point of the back section.

12. A golf club head comprising:

a body having a hosel, topline, face and a back section;

an opening in the body formed by the back section being spaced from the face; and at least one sole member provided to mate with the opening, the sole member including a sole portion having a front edge in contact with the rear surface of the face adjacent a leading edge, and a bend portion attached to at least a portion of the back section of the body and spaced from the face and a bridge portion joining the sole portion and the bend portion, wherein the sole member has a sole portion with a rear edge in contact with a bottom of the back section.

13. The golf club head of claim 12, wherein the rear edge in contact with the back section has a length of about 3 mm to 10 mm.

14. A golf club head comprising:

a main body defining a hosel, a back section, and a face, the face having a ball striking surface, a leading edge and a rear surface;

an opening in the body formed by the back section being spaced from the rear surface of the face; and at least two sole members shaped to be selectively positioned in the opening and attached to the back section of the main body, the sole member including a sole portion having a front edge in contact with the rear surface of the face adjacent the leading edge, and a bend portion attached to at least a portion of the back section of the body and spaced from the face and a bridge portion joining the sole portion and the bend portion, wherein the sole members have different bounce profiles, wherein the bridge has an angle relative to a ground plane and the angle is between about 30 degrees and about 60 degrees.

15. The golf club head of claim 14, wherein the opening is completely covered by the sole members.

16. The golf club head of claim 14, further comprising a mid-point of the back section and the selected sole member is attached to the body at the mid-point of the back section.

17. The golf club head of claim 14, further comprising fasteners connecting the sole member in the opening to the mid-point of the back section.

18. The golf club head of claim 14, wherein the face has a variable face thickness from about 1.9 mm to about 2.1 mm.

19. The golf club head of claim 18, wherein the variable face thickness increases from the sole to the topline.

20. The golf club head of claim 14, wherein the sole portion has a thickness from about 1 mm to about 4 mm.

21. The golf club head of claim 14, wherein the bridge has a thickness from about 1 mm to about 4 mm.

22. The golf club head of claim 14, further comprising a sole slot provided in the body for receiving a heel and toe of the sole portion of the sole member.

* * * * *